US005077842A

United States Patent [19]

Horne, Jr.

[11] Patent Number: 5,077,842

[45] Date of Patent: Jan. 7, 1992

[54] SHOWER APPARATUS

[76] Inventor: Francis L. Horne, Jr., 1240 30th St., Newport News, Va. 23607

[21] Appl. No.: 610,165

[22] Filed: Nov. 5, 1990

[51] Int. Cl.[5] ..... A47K 3/034; A47K 3/074

[52] U.S. Cl. ..... 41/568; 4/572; 4/585; 4/596; 4/599

[58] Field of Search ..... 4/568, 585, 586, 587, 4/468, 572, 592, 580, 496, 499

[56] References Cited

U.S. PATENT DOCUMENTS

| | | | |
|---|---|---|---|
| 1,658,944 | 2/1928 | Schaeffer | 4/572 |
| 2,528,825 | 11/1950 | Graves | 4/572 X |
| 2,581,883 | 1/1952 | Rechler | 4/586 |
| 2,728,920 | 1/1956 | Hylton et al. | 4/585 |
| 3,465,369 | 9/1969 | Ostrowsky | 4/568 |
| 3,799,228 | 3/1974 | Crawford | 4/587 |
| 4,034,424 | 7/1977 | Budlong | 4/580 X |
| 4,453,280 | 6/1984 | Greenleaf | 4/599 |

*Primary Examiner*—Daniel M. Yasich
*Attorney, Agent, or Firm*—Leon Gilden

[57] ABSTRACT

A shower apparatus for children in which an insert tubular framework assembly is defined by a generally parallelpiped configuration. The insert framework assembly is positioned in a bathtub and is connected to the water nozzle in a conventional manner to permit a child to safety utilize the shower apparatus within the bathtub. A deformable and adjustable shower head is mounted to the tubular framework assembly and can be positioned relative to the child within the tubular framework.

10 Claims, 4 Drawing Sheets

PRIOR ART

SHOWER APPARATUS

BACKGROUND OF THE INVENTION

1. Field of the Invention

The field of the invention relates to bathtub apparatus, and more particularly pertains to a new and improved bathtub apparatus wherein the same utilizes an insert positionable in a bathtub to permit a child to utilize a shower assembly in a safe and secure relationship within a bathtub member.

2. Description of the Prior Art

The use of a bathtub organization for a child to participate in a showering procedure frequently presents relative hazards to a child due to the relative size and lack of safety structure relative to a bathtub apparatus in relation to a child. The instant invention attempts to overcome deficiencies of the prior art by providing a framework to securely yet conveniently position a child therewithin while presenting an accessory shower nozzle in a convenient relationship relative to the child.

Examples of the prior art shower apparatus may be found in U.S. Pat. No. 4,282,612 to KING wherein an articulated shower conduit is arranged relative to a conventional bathtub to permit repositioning of the shower structure relative to an individual within the bathtub member.

U.S. Pat. No. 4,566,142 to ROBERTS et al sets forth a seat shower arrangement wherein side curtain members are mounted relative to a framework with a plurality of shower nozzles positioned about the framework to permit showering of a patent within the organization.

U.S. Pat. No. 4,453,280 to GREENLEAF sets forth a portable shower assembly for ease of disassembly and storage.

U.S. Pat. No. 4,539,720 to WASTERWELLER sets forth a personal shower stall wherein the same may be folded into a back pack like arrangement for transport.

As such, it may be appreciated that there continues to be a need for a new and improved shower apparatus as set forth by the instant invention which addresses both the problems of ease of use as well as effectiveness in construction in accommodating a child therewithin in a safe and convenient manner and in this respect, the present invention substantially fulfills this need.

SUMMARY OF THE INVENTION

In view of the foregoing disadvantages inherent in the known types of shower apparatus present in the prior art, the present invention provides a new and improved shower apparatus wherein the same provides an insert for use in combination with a bathtub member for permitting showering of an individual child therewithin. As such, the general purpose of the present invention, which will be described subsequently in greater detail, is to provide a new and improved shower apparatus which has all the advantages of the prior art shower apparatus and none of the disadvantages.

To attain this, the shower apparatus of the invention includes an apparatus insert positionable within a conventional bathtub member wherein the apparatus includes a rectangular framework including a polymeric floor with the polymeric floor including a laminated frictional mat member overlying an upper surface of the floor. The framework includes a lower fluid conduit telescopingly receiving an upper fluid conduit wherein the upper fluid conduit including a shower head mounted thereon. The lower fluid conduit includes a boss member selectively connecting a flexible hose to provide fluid communication between the lower fluid conduit and a faucet of the bathtub member.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shower apparatus which has all the advantages of the prior art shower apparatus and none of the disadvantages.

It is another object of the present invention to provide a new and improved shower apparatus which may be easily and efficiently manufactured and marketed.

It is a further object of the present invention to provide a new and improved shower apparatus which is of a durable and reliable construction.

An even further object of the present invention is to provide a new and improved shower apparatus which is susceptible of a low cost of manufacture with regard to both materials and labor, and which accordingly is then susceptible of low prices of sale to the consuming public, thereby making such shower apparatus economically available to the buying public.

Still yet another object of the present invention is to provide a new and improved shower apparatus which provides in the apparatuses and methods of the prior art some of the advantages thereof, while simultaneously overcoming some of the disadvantages normally associated therewith.

Still another object of the present invention is to provide a new and improved shower apparatus which may be compactly stored when not being utilized.

Yet another object of the present invention is to provide a new and improved shower apparatus easily installed and positioned within a bathtub member in association therewith for orienting a shower facility in a convenient relationship relative to a child arranged within the apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
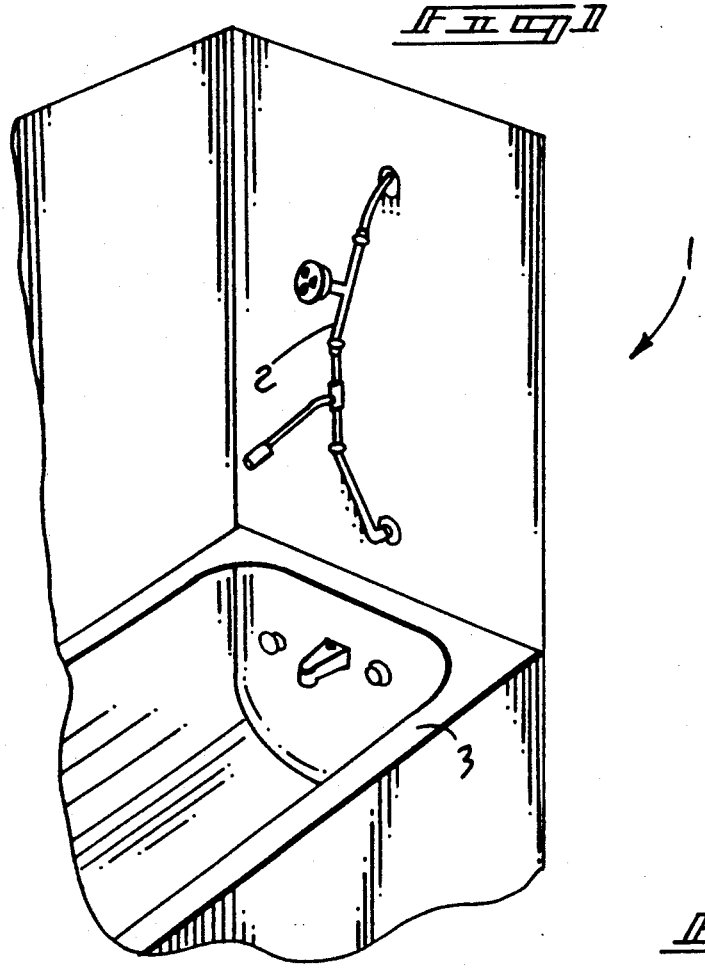
FIG. 1 is an isometric illustration of a prior art shower apparatus.

With reference now to the drawings, and in particular to FIGS. 1 to 8 thereof, a new and improved shower apparatus embodying the principles and concepts of the present invention and generally designated by the reference numeral 10 will be described.

Figure 2:
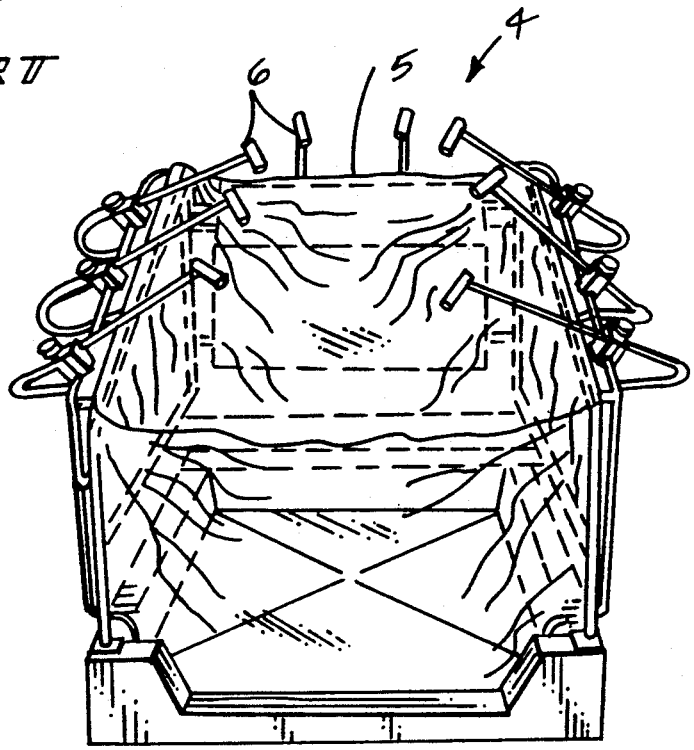
PRIOR ART Fig 2
FIG. 2 is an isometric illustration of a further prior art shower apparatus.

FIG. 1 illustrates a prior art shower apparatus 1 wherein a bathtub member 3 includes an articulated fluid conduit assembly 2 to permit repositioning and articulation of various shower nozzles mounted thereon. FIG. 2 illustrates a further prior art shower apparatus 4 wherein a flexible curtain 5 is mounted upon a framework with a plurality of shower heads positionable about the framework for the showering of a patent positioned within the apparatus.

More specifically, the shower apparatus 10 of the instant invention essentially comprises a bathtub member 11 that defines a cavity 12 with a water nozzle 13 overlying the cavity 12 for reception of water therewithin in a conventional manner.

Figure 3:
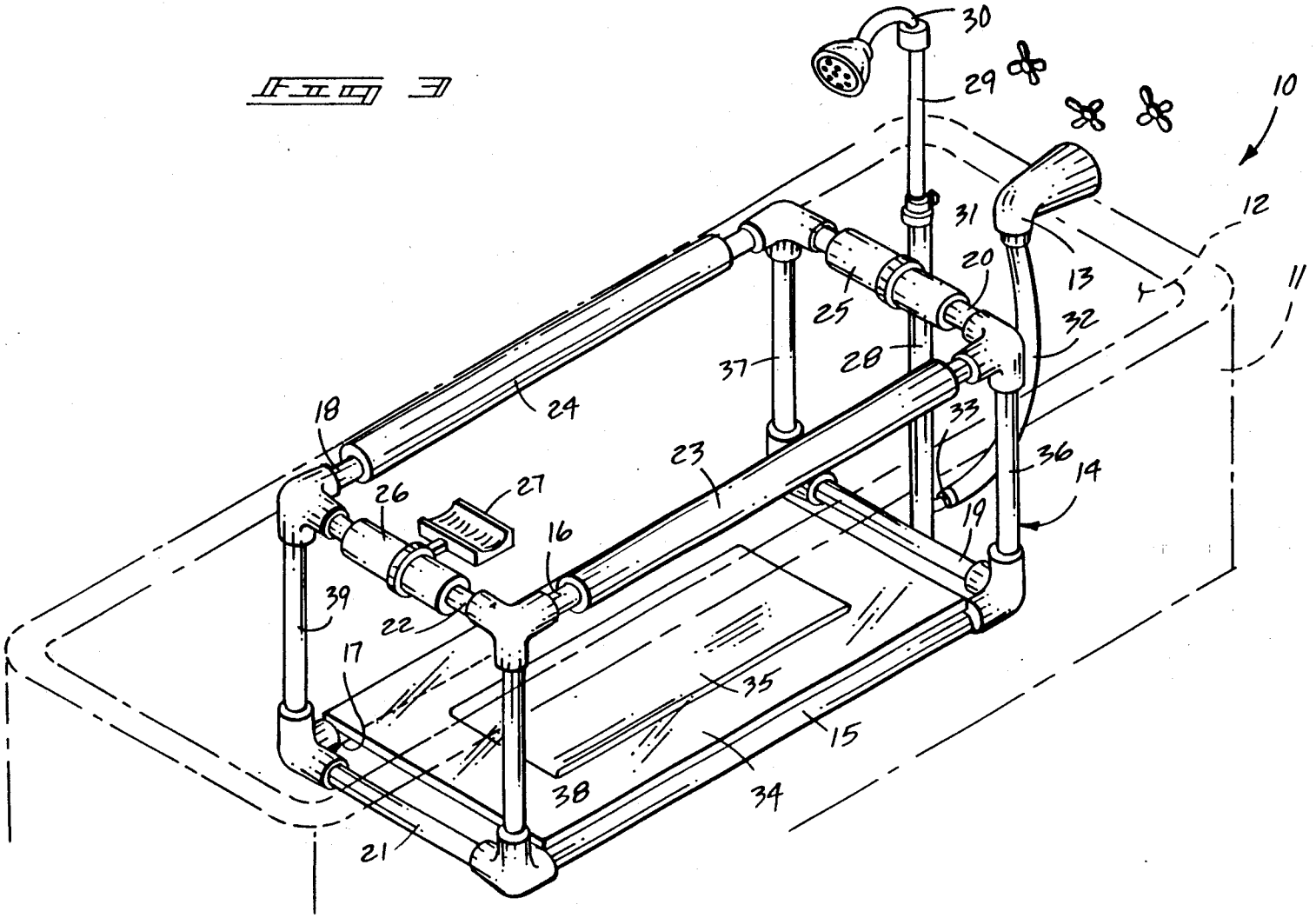
FIG. 3 is an isometric illustration of the instant invention.
Figure 4:
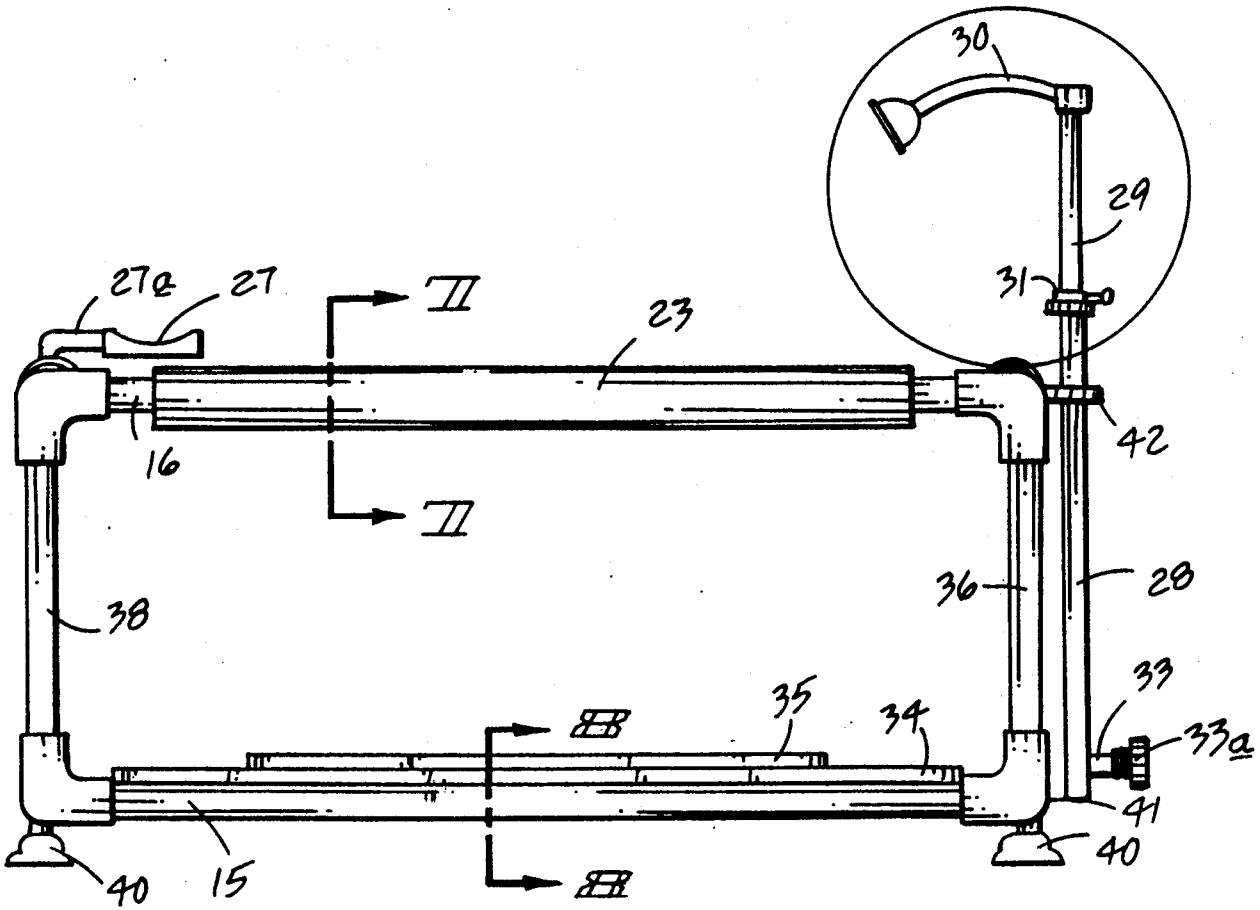
FIG. 4 is an orthographic side view taken in elevation of the instant invention.
Figure 5:
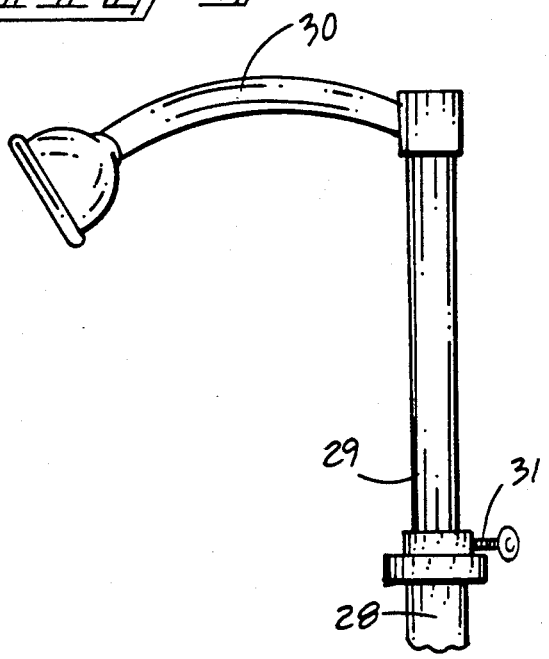
FIG. 5 is an orthographic side view of section 5 as set forth in FIG. 4.
Figure 6:
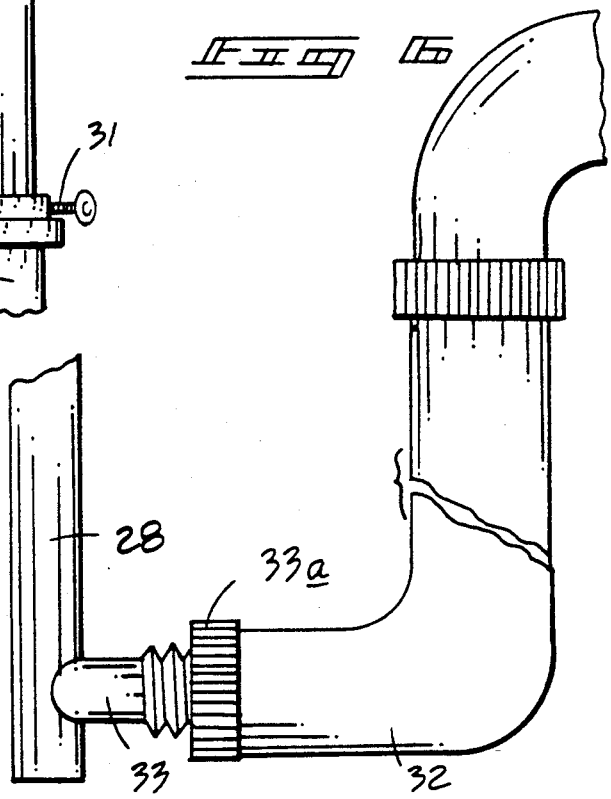
FIG. 6 is an orthographic side view somewhat enlarged of the flexible hose and connection to the shower apparatus of the instant invention.
Figure 7:
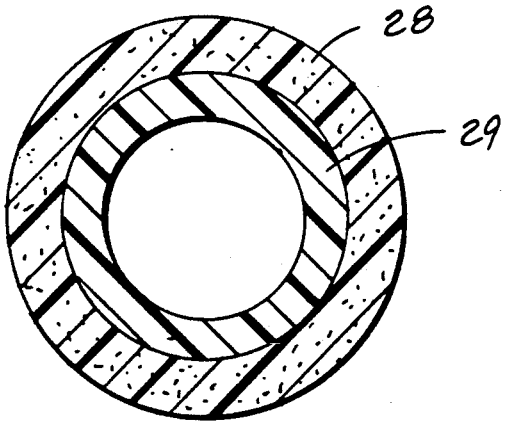
FIG. 7 is an orthographic view taken along the lines 7—7 of FIG. 4 in the direction indicated by the arrows.
Figure 8:
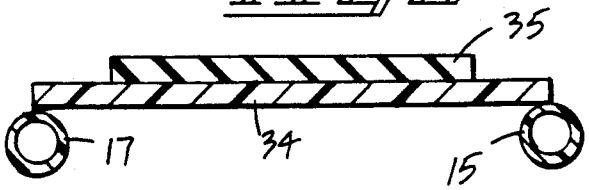
FIG. 8 is an orthographic view taken along the lines 8—8 of FIG. 4 in the direction indicated by the arrows.

A tubular framework 14 defined by a generally parallelepiped configuration includes a plurality of horizontal parallel tubes defining a right lower and upper tube 15 and 16 spaced parallel relative to one another and each aligned with a respective left lower and upper tube 17 and 18. Forward lower and upper tubes 19 and 20 are spaced from and parallel to respective rear lower and upper tubes 21 and 22 to define the rectangular parallelepiped configuration in cooperation with right and left forward legs 36 and 37 and right and left rear legs 38 and 39 wherein the legs 36 through 39 are orthogonally oriented relative to the tube members 15 through 22 during intersections of the right and left tubes with the forward and rear tubes as illustrated in FIG. 3. A right and left tubular pad member 23 and 24 is surroundingly positioned about the respective right and left upper tube 16 and 18 with a comparable forward and rear tubular pad member 25 and 26 surroundingly encompassing an associated forward upper tube 20 and a rear upper tube 22 to provide a padded rectangular upper framework minimizing injury by a child positioned within the framework. A concave soap dish 27 is mounted about the upper tube 22 and the associated rear tubular pad member 26 and includes a connecting arm 27*a* to secure the concave soap dish to the rear pad member 26 as illustrated.

A lower vertical shower conduit 28 includes a respective lower and upper brace 41 and 42 (see FIG. 4) to mount the lower shower conduit 28 to the respective forward lower and upper tube 19 and 20 in an orthogonal relationship. The lower shower conduit 28 telescopingly receives an upper shower conduit 29 therewithin with the lower shower conduit including an internal diameter substantially equal to an external diameter defined by the upper shower conduit 29 to provide a complementary relationship between the lower and upper shower conduits 28 and 29. A deformable shower head 30 is mounted to an upper terminal end in fluid communication to the upper shower conduit 29 to permit positioning of the shower head structure relative to a child positioned within the tubular framework 14. A friction clamp 31 threadedly directed orthogonally and diametrically through the lower shower conduit 28 provides frictional engagement with the upper shower conduit 29 to provide selective positioning in adjustment of the upper shower conduit relative to the lower shower conduit. A fluid boss 33 in fluid communication with the lower shower conduit 28 includes a boss connector 33*a* to threadedly secure a flexible connecting conduit 32 to the boss connector 33*a* at one end of the flexible connecting conduit 32 and at an upper end of the flexible connector conduit 32 to the water nozzle 13.

A polymeric floor plate 34 is mounted integrally to an upper surface of the right and left lower tubes 15 and 17 and coextensive therewith to include a frictional flexible mat 35 laminated to an upper surface of the floor plate 34 to provide a frictional surface to prevent slippage of a child within the framework 14. Suction cup members 40 are orthogonally and downwardly mounted at the intersections defined by the right and left lower tubes 15 and 17 and the forward and rear lower tubes 19 and 21 to provide engagement between the framework 14 and the bathtub member 11 when the framework 14 is positioned and mounted within the bathtub member cavity 12.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shower apparatus for children comprising in combination, a bathtub member, the bathtub member including an elongate cavity therewithin and a water nozzle overlying the bathtub cavity, and a tubular insertable framework, the tubular framework including a right and left lower tube in a coextensive parallel relationship in the cavity of said bathtub member, and a floor plate overlying and mounted coextensively with the right and left lower tube, and the framework further including a lower vertical shower conduit fixedly mounted to the framework, the lower shower conduit telescopingly receiving an upper vertical shower conduit, and the upper vertical shower conduit including deformable shower head in fluid communication with the upper vertical shower conduit to permit manual manipulation of the shower head, and a flexible connecting conduit in fluid communication between the lower vertical shower conduit and the water nozzle for directing water flow through the shower head.

2. Apparatus as set forth in claim 1 wherein the tubular framework includes a respective right and left upper tube coextensive with and overlying the respective right and left lower tube, and a forward upper and lower tube arranged parallel to one another with the forward upper tube orthogonally and integrally mounted to the right and left upper tube with the forward lower tube orthogonally and integrally mounted to the right and left lower tube, and an upper and lower rear tube, the upper rear tube orthogonally and integrally mounted to the right and left upper tube spaced from and parallel to the forward upper tube, and the rear lower tube integrally and orthogonally mounted to the right and left lower tube spaced from and parallel to the forward lower tube wherein the tubular framework defines a parallelepiped configuration.

3. Apparatus as set forth in claim 2 wherein the right upper tube includes a right tubular pad member formed thereabout, the left upper tube includes a left tubular pad member formed thereabout, the forward upper tube includes a forward tubular pad member formed thereabout, and the rear upper tube includes a rear tubular pad member formed thereabout to define a padded rectangular framework within the tubular framework.

4. Apparatus as set forth in claim 3 wherein the rear tubular pad member includes a connector arm mounted thereto with the connector arm including a soap dish with the soap dish positioned interiorly of the tubular framework.

5. Apparatus as set forth in claim 4 wherein the lower vertical shower conduit includes a lower brace and an upper brace orthogonally mounted to the lower vertical shower conduit with the lower brace mounted to the forward lower tube and the upper brace mounted to the forward upper tube.

6. Apparatus as set forth in claim 5 including a friction clamp threadedly and diametrically directed through the lower vertical shower conduit for frictional engagement with the upper vertical shower conduit to permit vertical adjustment of the upper vertical shower conduit relative to the lower vertical shower conduit.

7. Apparatus as set forth in claim 6 wherein the lower vertical shower conduit defines a predetermined internal diameter and the upper vertical shower conduit defines a predetermined external diameter wherein the external diameter is substantially equal to the internal diameter.

8. Apparatus as set forth in claim 7 wherein the floor plate is formed of a polymeric material and includes a frictional mat laminated to and mounted to an upper surface of the floor plate.

9. Apparatus as set forth in claim 8 wherein the lower vertical shower conduit includes a fluid boss in fluid communication with the lower vertical shower conduit and the fluid boss includes a boss connector to selectively secure a lower terminal end of the flexible connecting conduit to the boss connector, and an upper terminal end of the flexible connector conduit mounted to the water nozzle.

10. Apparatus as set forth in claim 8 wherein the rear lower tube and the right lower tube are joined at a first center section, the rear lower tube and the left lower tube define a second intersection, the forward lower tube and the right lower tube defining a third intersection, and the forward lower tube and the left lower tube defining a third intersection with each intersection including a suction cup member mounted thereto with the suction cup member mounted downwardly relative to the framework for engagement with the bathtub member to secure the tubular framework relative to the bathtub member.

* * * * *